US007832677B2

(12) United States Patent
Lannes et al.

(10) Patent No.: US 7,832,677 B2
(45) Date of Patent: Nov. 16, 2010

(54) METHOD AND AN APPARATUS FOR CONTROLLING A NIP PROFILE OF A REELING NIP

(75) Inventors: Petteri Lannes, Jokela (FI); Tatu Pitkänen, Nummenkylä (FI); Ilkka Naatti, Helsinki (FI); Jari Tiitta, Kellokoski (FI); Rami Vanninen, Kellokoski (FI); Marko Tiilikainen, Kellokoski (FI)

(73) Assignee: Metso Paper, Inc., Helsinki (FI)

( * ) Notice: Subject to any disclaimer, the term of this patent is extended or adjusted under 35 U.S.C. 154(b) by 672 days.

(21) Appl. No.: 11/571,373

(22) PCT Filed: Jun. 30, 2005

(86) PCT No.: PCT/FI2005/050255

§ 371 (c)(1),
(2), (4) Date: Feb. 19, 2007

(87) PCT Pub. No.: WO2006/005804

PCT Pub. Date: Jan. 19, 2006

(65) Prior Publication Data

US 2008/0006730 A1 Jan. 10, 2008

(30) Foreign Application Priority Data

Jun. 30, 2004 (FI) ..... 20045255

(51) Int. Cl.
*B65H 18/26* (2006.01)

(52) U.S. Cl. ..... 242/541.4; 242/413; 242/541.3; 242/541.7; 242/564.5

(58) Field of Classification Search ..... 242/541.1, 242/541.3, 541.4, 541.5, 541.6, 541.7, 542.3, 242/564.5, 532.2, 422.6, 422.7, 422.8, 420.2, 242/420.3, 547

See application file for complete search history.

(56) References Cited

U.S. PATENT DOCUMENTS 3,098,619 A * 7/1963 Washburn ..... 242/541.3

(Continued)

FOREIGN PATENT DOCUMENTS

EP 0 860 391 A1 8/1998

(Continued)

OTHER PUBLICATIONS

International Preliminary Report on Patentability issued in PCT/FI2005/050255.

(Continued)

*Primary Examiner*—William A Rivera
(74) *Attorney, Agent, or Firm*—Stiennon & Stiennon

(57) ABSTRACT

A method and an apparatus for controlling the cross-directional nip profile of a reeling nip in a reeler, in which the reeling nip is arranged by means of a reeling core or a growing machine reel and at least one loop of an endless supporting member continuous in the direction of the axis of the reeling core. To control the cross-directional nip profile of the reeling nip, variables proportional to the tension of the supporting member are measured, cross-directional tension profile of the supporting member is determined on the basis of said variables, and further, a cross-directional nip profile of the reeling nip is determined, said nip profile being controlled by adjusting the determined cross-directional tension profile of the supporting member.

29 Claims, 7 Drawing Sheets

U.S. PATENT DOCUMENTS

| | | | | | |
|---|---|---|---|---|---|
| 4,746,076 | A | * | 5/1988 | Tomma et al. | 242/541.3 |
| 5,048,353 | A | | 9/1991 | Justus | |
| 5,150,850 | A | * | 9/1992 | Adams | 242/541.3 |
| 5,251,835 | A | | 10/1993 | Kyytsönen | |
| 5,379,652 | A | | 1/1995 | Allonen | |
| 5,531,396 | A | * | 7/1996 | Kinnunen et al. | 242/541.3 |
| 5,690,298 | A | | 11/1997 | Rück | |
| 5,699,729 | A | | 12/1997 | Moschel | |
| 5,901,918 | A | | 5/1999 | Klerelid et al. | |
| 5,918,830 | A | * | 7/1999 | Verajankorva et al. | 242/541.1 |
| 6,216,976 | B1 | * | 4/2001 | Hendrix | 242/541.7 |
| 6,332,589 | B1 | * | 12/2001 | Moller et al. | 242/541.3 |
| 6,536,702 | B1 | * | 3/2003 | Vargo et al. | 242/541.3 |
| 6,622,958 | B1 | * | 9/2003 | Luomi et al. | 242/541.1 |
| 6,629,659 | B1 | | 10/2003 | Innala et al. | |
| 6,698,681 | B1 | | 3/2004 | Guy et al. | |
| 7,100,862 | B2 | * | 9/2006 | Skarzenski et al. | 242/541.3 |
| 7,398,943 | B2 | * | 7/2008 | Horneck et al. | 242/541.3 |
| 2004/0244609 | A1 | | 12/2004 | Muhs | |

FOREIGN PATENT DOCUMENTS

| | | | |
|---|---|---|---|
| FI | 113697 | B | 5/2004 |
| FI | 4113804 | B | 6/2004 |
| WO | 98/55384 | A1 | 12/1998 |
| WO | 03/004389 | A1 | 1/2003 |
| WO | 2006/003258 | A2 | 1/2006 |
| WO | 2006/005804 | A1 | 1/2006 |

OTHER PUBLICATIONS

International Search Report issued in PCT/FI2005/050255.
Search Report issued in FI 20045255.

* cited by examiner

METHOD AND AN APPARATUS FOR CONTROLLING A NIP PROFILE OF A REELING NIP

CROSS REFERENCES TO RELATED APPLICATIONS

This application is a national stage application of International App. No. PCT/FI2005/050255, filed Jun. 30, 2005, the disclosure of which is incorporated by reference herein, and claims priority on Finnish App. No. 20045255, filed Jun. 30, 2004, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for controlling the cross-directional profile of a reeling nip. The invention also relates to an apparatus for implementing the aforementioned method.

In the final end of a machine manufacturing paper, paperboard, soft tissue or the like or a finishing apparatus for paper, paperboard or soft tissue or the like, a paper web which is typically several meters wide and which has been produced and/or treated in the preceding machine sections, is reeled around a reeling shaft, i.e. a reel spool to form a machine reel. In this reeling up process a reeling cylinder that is bearing-mounted rotatable is typically used for guiding the paper web on the machine reel, wherein the nip contact between the reeling cylinder and the machine reel is utilized to influence the quality of the reel produced thereby. The ends of the reel spool are affected by means of a suitable loading mechanism to adjust the nip contact between the machine reel that is being formed and the reeling cylinder. Such reeling concepts and loading methods related thereto are disclosed, for example, in the Finnish patent 91383 and in the corresponding U.S. Pat. No. 5,251,835, as well as in the Finnish patent application 950274 and in the corresponding U.S. Pat. No. 5,690,298.

The measurement of the cross-directional profile of such a reeler is disclosed for example in the U.S. Pat. No. 5,048,353 in which one or several sensors operating on piezoelectric principle have been installed on the surface layer of the reeling cylinder, said sensors reacting to the pressure prevailing in the nip. The sensors have been installed spirally around the length of the reeling cylinder so that they measure the cross-directional profile of the pressure prevailing in the reeling nip.

In addition, the publication EP-860391 discloses a reeler, in which the web is guided on a reel via a supporting member formed of several endless belts or wires arranged next to each other in the longitudinal direction of the guide roll, said supporting member being passed via the guide rolls. Thus, by means of the belt loops it is possible to attain a long reeling nip having an even pressure in the area of the lower half of the reel. The aim is to control the nip pressure of the reeling nip through the tension of individual belt loops. Thus, each belt loop requires separate belt tensioning means. According to the publication, it is possible to profile the nip pressure on the basis of the measured tension of individual belt loops. It is a problem in this solution that because the supporting member is composed of several belt loops arranged next to each other in the longitudinal direction of the guide roll, it is difficult to monitor the condition of the belts, and maintain and repair them. Furthermore, it is difficult to control the rotation speed of separate belt loops, and it requires separate controlling means. It is also difficult to hold the belts moving in the machine direction in their correct locations in the longitudinal direction of the guide rolls so that they do not drift on top of each other. Furthermore, the separate belt tensioning means required by each belt loop causes lack of space in the surroundings of the reeler.

Furthermore, the WO publication 98/55384 discloses a reel-up in which the reeling nip is formed by means of a loop of a supporting member and a reel spool. The total tension of the belt is controlled by means of load cells attached to a guide roll guiding the belt. The total tension of the belt thus attained is also used for controlling the nip pressure of the reeling nip.

Both when using a conventional reeler based on a reeling cylinder and a belt reeler utilizing a supporting member according to the above-mentioned EP publication 860391 and WO publication 98/55384 there is a basic problem in the reeling process: it is difficult to get an even cross-directional profile in the machine reel that is being produced. Consequently, the irregularities produced in the reeling, such as creases caused by the slackness of the belt, and local dents caused by excessive tension of the web, transfer to the customer rolls. In the above-mentioned publications attempts have been made to solve this problem by means of controlling the cross-directional linear pressure of the reeling nip. This is, however, difficult, because the controlling requires accurate measurement results. The solutions shown in the publications EP860391 and WO 98/55384 are based on the controlling of the nip pressure of the reeling nip through the total tension of the belt. This is not a sufficiently accurate method to eliminate the problems in the reeling.

SUMMARY OF THE INVENTION

Therefore, the purpose of the present invention is to provide a method and an apparatus for controlling the cross-directional nip profile of a reeling nip, which avoids the above-mentioned problems and by means of which the nip profile of the reeling nip of the belt reeler can be controlled easily and in a simple manner. By means of the invention it is possible to attain a uniform structure in the machine reels produced in a belt reeler, and the creases and dents produced in the reels by the uneven nip profile can be eliminated.

In the controlling of the nip profile the invention utilizes at least partly the components already existing in the belt reeler, wherein it is not necessary to apply space occupying additional parts and apparatuses. In some of the embodiments of the invention the existing components are replaced with new components that implement the adjustment task.

In this description and in the claims the term endless supporting member refers to a flexible belt or wire in the form of an endless loop that is substantially continuous in the direction of the axis of the reeling core, the width of which belt or wire is substantially equal to the width of the web to be reeled, and which travels in the machine direction by the effect of the rotating movement of the guide rolls. The belt reeler, in turn, refers to a reeler in which the reeling nip is formed by means of the above-presented supporting member and a growing machine reel. The reeling core refers to a core or a reel spool around which the web of paper, paperboard, tissue or the like is reeled.

The invention is based on the idea that the nip profile of the reeling nip is controlled by adjusting the tension profile of the supporting member. Namely, it has been noted that in a belt reeler the tension profile of the supporting member correlates with the nip profile of the reeling nip and that the changes in the tension profile of the supporting member transfer to the nip profile of the reeling nip. By adjusting the tension profile of the supporting member it is thus possible to affect the nip profile of the reeling nip.

The nip profile of the reeling nip can be controlled by means of on-line control by determining the tension profile of the supporting member, and by affecting actively on the tension profile the basis of the determined tension profile by producing a change either in the guide roll that is in contact with a supporting member or in the supporting member itself, said change affecting the tension profile of the supporting member that is in contact with the guide roll, thus producing the desired final result in the nip profile of the reeling nip. The actively produced change refers to a change produced either in the surface structure or shape of the guide roll or in the supporting member on the basis of a control command. When a guide roll that guides the supporting member is used in profiling the tension profile, it is possible to form profiling zones on the surface of the guide roll, for example by means of loading elements supporting the shell of the guide roll from inside with different loads, or by forming the shell or coating of the guide roll with zones. It is also possible to affect the tension profile of the supporting member by forming the profiling guide roll of several shorter rolls that can be moved with respect to each other, or by using a bending roll as a profiling guide roll.

When the profiling of the tension profile of the supporting member is performed by producing an active change directly on the supporting member, it is for example possible to direct an external stimulus, such as heating on the surface of the supporting member, which causes a change in the tension profile.

The measurements needed for determining the tension profile of the supporting member are advantageously conducted by measuring means placed in a guide roll guiding the supporting member. Preferably, the guide roll containing the measuring means is positioned immediately before the reeling nip. It is also possible to perform the measurements with measuring means positioned in the supporting member itself. On the basis of the nip profile determined on the basis of the tension profile of the supporting member, the change correcting the tension profile of the supporting member is produced by means of a profiling component of the belt reeler, either with a guide roll or the supporting member itself. The guide roll or the supporting member is affected by means of an external or internal stimulus into the direction of the desired change. If the adjustment of the tension profile is conducted by means of a profiling guide roll guiding the supporting member, it is advantageously positioned after the reeling nip. The measurements necessary for determining the tension profile of the supporting member and the adjustment of the tension profile can also be implemented by means of only one guide roll that is in contact with the supporting member. Thus, the measuring means are positioned in the same roll which also performs the operations necessary for adjusting the tension profile.

The controlling of the nip profile of the reeling nip is advantageously performed in such a manner that the measurements necessary for determining the tension profile of the supporting member are conducted with measuring means arranged in the guide roll located before the reeling nip, and thus the nip profile is also controlled by means of a guide roll positioned after the reeling nip.

The measuring means, i.e. measuring sensors used in the measurements necessary for determining the tension profile measure variables proportional to the tension of the supporting member, such as force or pressure exerted by the supporting member on the surface of the guide roll. Suitable sensors are typically of such a type that they are capable of changing the pressure or load exerted thereto into a signal that can be conducted via a suitable conductor or wirelessly to a data processing unit, in which it can be processed in a manner known from processing of measurement signals. In the tight zones of the belt, higher amount of pressure/load is exerted on the sensor than in the slack sections, wherein the variations in the pressure/load in the lateral direction of the supporting member produce the cross-directional tension profile of the supporting member, i.e. the CD profile. The sensors to be attached to the supporting member are also of the same type as discussed hereinabove. The measuring sensors arranged in the supporting member measure the load/pressure exerted on the supporting member in the reeling nip, i.e. when the part of the supporting member comprising the measuring sensors and the reel spool or the machine reel that is being formed are in contact with each other. The tension profile of the supporting member can be calculated from these measurements. The cross-directional linear load profile of the reeling nip is attained directly from these measurements, and thus a calculatory conversion tension profile ->cross-directional profile of the linear load is not necessary.

The nip pressure of the reeling nip can also be controlled without an on-line control, i.e. continuous measurement of variables proportional to the tension of the supporting member and determination of the tension profile and without a change actively produced on the surface structure or shape of the guide roll on the basis of a control command. These control methods are based on either experimentally or calculatorily produced nip models for the supporting member. The nip models are dependent on the paper grade to be manufactured and on the properties of the same, such as basis weight, thickness and porosity, and in these nip models the control actions affecting the nip profile of the reeling nip and the tension profile of the supporting member have been determined beforehand either experimentally or by means of calculations. In other words, the desired nip profile of the reeling nip of the paper grade to be reeled has been determined beforehand for said paper grade, and the profiling means, i.e. the profiling guide roll or the supporting member are manufactured so that they comply with said nip model, typically so that they vary in zones in the cross-directional (CD) of the supporting member, and they are installed in their place before starting the reeling process. Thus, the profiling zones are determined by the nip model. In such control methods of the nip profile of the reeling nip it is not possible to affect the tension profile of the supporting member after the supporting member or guide roll that is manufactured with variable zones is positioned in its place, but the tension profile of the supporting member remains the same during the entire reeling process, until the supporting member or guide roll is changed.

In the following, the invention will be described in more detail with reference to the appended drawings.

DESCRIPTION OF THE PREFERRED EMBODIMENTS

Figure 1:
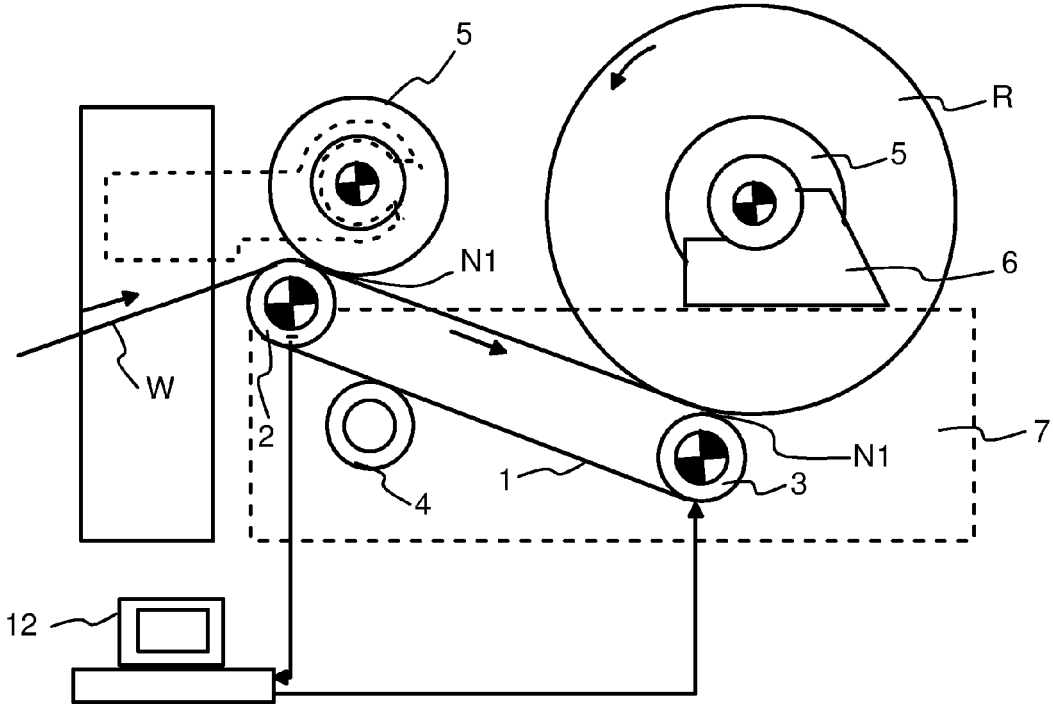
FIG. 1 illustrates schematically the main principle of a belt reeler in a side view.

FIG. 1 illustrates a continuously operating reel-up, where a paper web W, which is normally several meters wide and comes from a preceding section of a paper machine or a finishing apparatus for paper, travels via a reeling nip N1 to a reel R. Said reel-up is a so-called belt reel-up in which the reeling nip is formed by means of a flexible supporting member 1 in the form of an endless loop, such as a belt or a wire. The supporting member 1 is guided via two guide rolls 2 and 3, at the location of each of which the run of the member 1 turns to the opposite direction. In the travel direction of the web the first guide roll 2 can form a "hard nip" with the reel being started at the initial stage of the reeling in such a manner that the supporting member 1 is in contact with the reel at a point where the member travels supported by the guide roll 2 on the surface of the roll. The second guide roll 3 can be a driven roll, i.e. a traction roll, or separate drives can be arranged for both rolls. The web travels guided by the supporting member 1 onto the machine reel R, which is formed around a reeling core, i.e. a reel spool 5 rotatable with a center drive of its own. It is possible for the reel spool 5 to move in the machine direction with respect to the loop of the supporting member 1, and this is arranged in such a manner that the bearing housings at the ends of the reel spool that enable the rotation of the reel spool 5 are at both ends of the reel spool supported on carriages, i.e. transfer devices 6 that move on supporting structures 7. In connection with the reeler, there is also a storage of empty reel spools 5 (not shown), from which the rolls are brought to the change station at the location of the first guide roll 2 in order to change the web going to the machine reel R that is becoming full. The reel change takes place at production speed i.e. the paper web passed at high speed to the full reel is changed to travel onto a new, empty reel spool brought to the change station. In addition to the guide rolls 2 and 3, the endless belt loop 1 is also in contact with a guide roll 4, which can be provided with a drive or which can be driveless, and which guides the supporting member 1 from below the loop of the supporting member.

To determine and control the nip profile of the reeling nip N1, the tension profile of the supporting member 1 is determined. For measuring the variables proportional to the tension of the supporting member and necessary for determining the tension profile of the supporting member 1, either the guide roll 2 or 4 or the supporting member 1 is provided with a measuring means (9*a*, 9*b*, 9*c*, or 9*d*).

Figure 2:
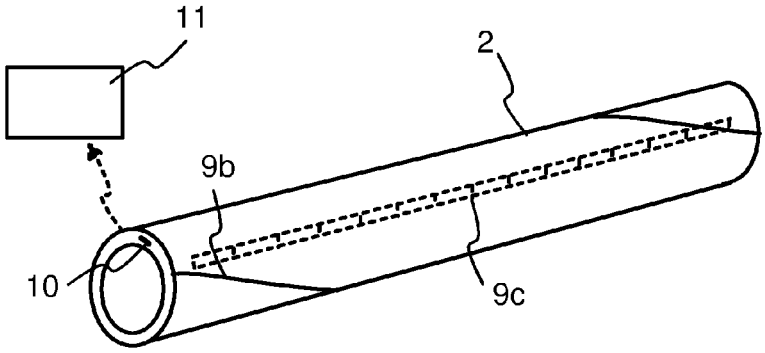
FIG. 2 shows schematically a guide roll used in the method according to the invention, as well as alternative measuring sensors arranged therein.

The measuring means, i.e. the measuring sensor (9*a*, 9*b*, 9*c*, or 9*d*) arranged in the guide roll 2 or 4 is for example a sensor operating on piezoelectric principle, for example an EMFi film or PVDF film, which are capable of changing a mechanical input variable, such as pressure or load into an electric output variable that can be processed by means of measurement technology. These film-like sensors are positioned on top of or inside the roll coating as point-like sensors, narrow spiral-like band or separate film slips to circle the roll within its entire length, wherein it is ensured that measurement results can be attained from the entire length of the roll. The positioning of the band-like sensor 9*b* in the guide roll is shown in FIG. 2, in which the roll presented therein is marked with the reference numeral 2, but said roll can be any guide roll or traction roll guiding the supporting member. The slip-like measuring sensors 9*c* can be positioned in the guide roll also successively in the direction of the axis of the roll, as shown by means of broken lines in FIG. 2. Thus, each sensor slip produces a measurement signal that represents the pressure exerted on the sensor element at the location of said slip, and by combining the measurements the tension profile of the supporting member is produced. The slip-like sensors each require a separate measurement channel. The measurement information i.e. the measurement variables are transferred out of the roll most advantageously in a wireless manner, for example by means of a telemetry transmitter 10 positioned in the roll. The measurement signal is received by means of a receiver 11, and transferred for processing and determining of the tension profile of the supporting member and the nip pressure profile of the reeling nip to a data processing unit 12, which is shown in FIG. 1. The receiver 11 itself may also comprise a data processing unit necessary for processing of the measurement signal.

Figure 3:
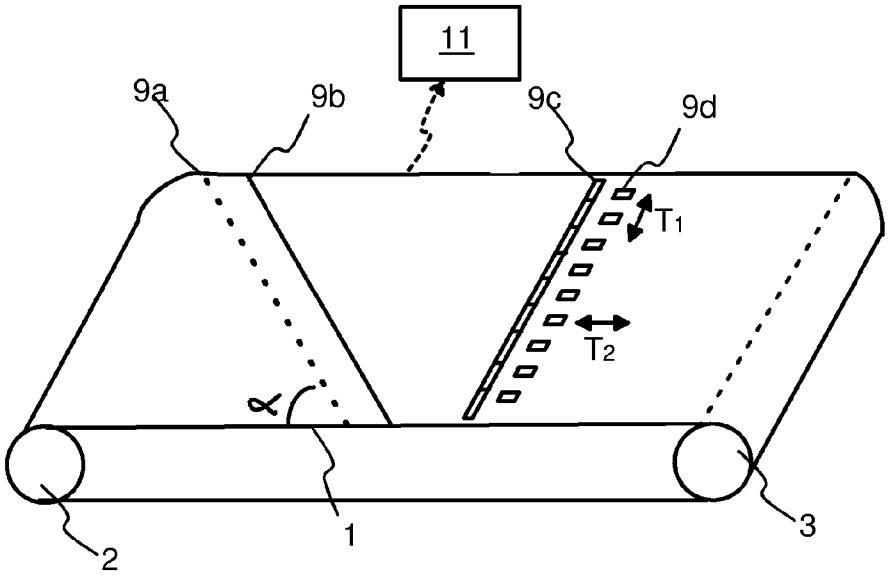
FIG. 3 shows schematically a supporting member used in the method according to the invention, as well as alternative measuring sensors arranged therein.

As stated above, the sensors attached to the supporting member may also be point-like sensors, narrow, band-like sensors or separate slips positioned successively. FIG. 3 shows a supporting member 1 in which four different alternatives are arranged as measuring sensors (9*a*, 9*b*, 9*c*, or 9*d*), as well as the positioning of said measuring sensors.

When point-like sensors 9*a* are used in the measurement, they are arranged in a row within suitable intervals from each other, obliquely across the width of the supporting member 1, as shown in FIG. 3. When a film-like narrow band sensor 9*b* is used, it is also positioned directly in an oblique position across the width of the supporting member. The straight line formed both by the point-like and band-like sensors forms an angle $\alpha$ with the edge of the supporting member 1. The width of the angle is selected in accordance with the desired measurement resolution.

It is possible to provide the supporting member 1 with measuring sensors by positioning successive slip-like measuring sensors 9*c* perpendicularly across the width of the supporting member 1, as shown in FIG. 3. FIG. 3 also shows the positioning of measuring sensors 9*d* composed of strain gauges, which is conducted by positioning them successively, within a fixed distance from each other, and as shown in the preceding alternative, perpendicularly across the width of the supporting member 1. The measuring sensors can be arranged so that they replace the wire threads of the supporting member (band-like sensor) or they can be arranged between the wire threads. The essential aspect is that they do not leave marks on the web to be reeled.

When the measuring sensors are arranged in the supporting member, they measure variables proportional to the tension of the supporting member in the reeling nip N1, i.e. when the measuring sensors 9 arranged in the supporting member 1 and the reel spool 5 or the machine reel R that is being formed are in contact with each other. It is possible to obtain the cross-directional linear load profile of the reeling nip directly from these measurements.

The measurement results from the measuring sensors (9*a*, 9*b*, 9*c*, or 9*d*) attached to the supporting member 1 can be transferred out of the sensor in a number of different ways, for example by means of slide wires positioned on the surface of the supporting member and brushes attached to one guide roll, wherein the measurement information can be transferred outside through the guide roll. The measurement information can also be transferred out of the supporting member in a wireless manner, for example by means of a transmitter positioned in the supporting member, and the signal transmitted by said transmitter is received in a receiver 11 positioned in the vicinity of the supporting member. Inside the loop of the supporting member it is also possible to place a beam-like data transmission means perpendicularly to the width of the supporting member and transmitting information in a contactless or contact-oriented manner.

The controlling of the nip profile of the reeling nip N1 takes place by affecting the tension profile of the supporting member 1. Before producing changes in the tension profile of the supporting member, it is necessary to determine the current nip profile of the reeling nip N1, i.e. the nip profile before the control actions on the basis of which the tension profile is adjusted to produce the desired nip profile of the reeling nip. In on-line controlling, the measurements necessary for determining the tension profile of the supporting member and the resulting control actions are conducted continuously. FIG. 1 shows the most advantageous embodiment of the invention, in which the measurements necessary for determining the tension profile of the supporting member 1 are performed by means of a guide roll 2 located before the reeling nip N1, and the guide roll affecting the tension profile of the supporting member, i.e. the profiling guide roll 3 is positioned immediately after the reeling nip N1. FIG. 1 also shows a data processing unit 12, in which the tension profile of the supporting member is determined on the basis of the obtained measurement results, and the nip profile is determined on the basis of the determined tension profile of the supporting member. The actions relating to the controlling of the nip profile are also shown in FIG. 4, which shows in a schematical and highly reduced manner an adjustment method according to the invention.

Figure 4:
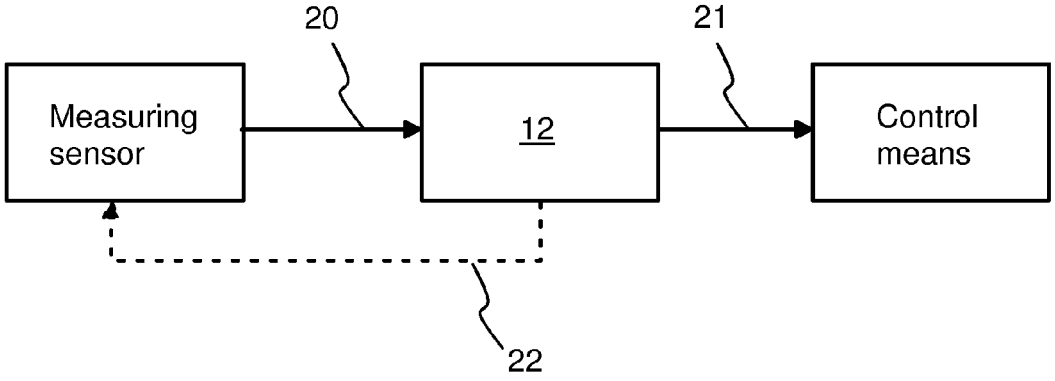
FIG. 4 shows schematically and in a highly reduced manner a control method according to the invention.

In FIG. 4, the measurement variables, i.e. a measurement message 20 obtained from the measuring means, i.e. the measuring sensor (9*a*, 9*b*, 9*c*, or 9*d*) arranged either in a guide roll 2, 3, or 4 guiding the supporting member, or in the supporting member 1, are transmitted to the calculation and adjustment unit, i.e. data processing unit 12. In the data processing unit the tension profile of the supporting member 1 is determined on the basis of the measurements, and the nip profile of the reeling nip N1 is produced thereof by means of calculations. If the produced nip profile deviates from the desired nip profile best possible for the reel formation, i.e. set profile, a control message 21 is transmitted to the tension profile adjustment means, i.e. to a guide roll guiding the supporting member, i.e. a profiling guide roll or supporting member, or to an apparatus affecting them and causing the profiling. On the basis of the control message the control means affect the profiling zones of the guide roll or supporting member so that it is possible to make the nip profile to comply with the set value. If the measurement and adjusting of the tension profile of the supporting member take place in the same guide roll, the control message is, of course, transmitted to said guide roll, as shown by means of broken lines 22 in FIG. 4. When the guide rolls are used in controlling the nip profile, it is most advantageous to use a combination of apparatuses in which in the measurement of the tension profile of the supporting member a guide roll 2 positioned immediately before the reeling nip is used and in the adjustment the guide roll 3 located immediately after the reeling nip is used.

Figure 5:
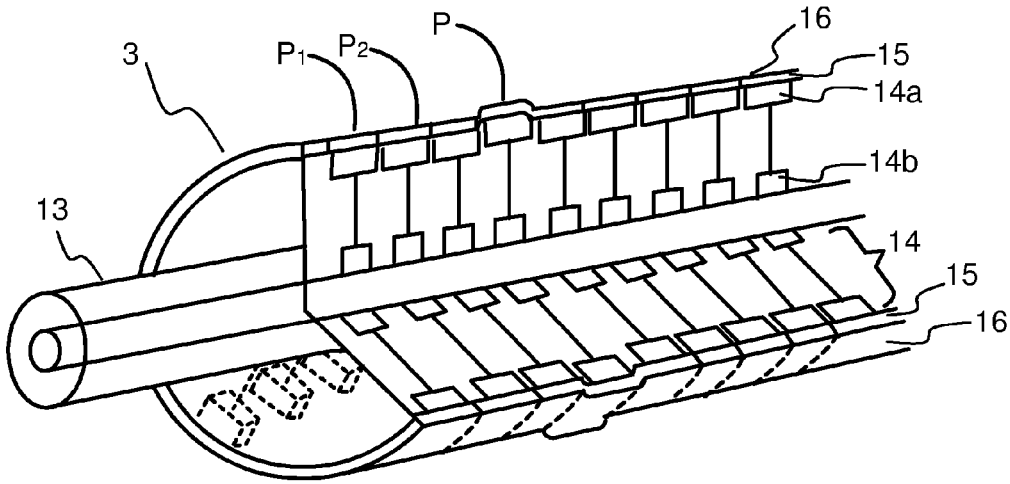
FIG. 5 shows schematically a guide roll used in the method according to the invention in a perspective view and in a partial cross-section in the longitudinal direction.

FIG. 5 shows a profiling guide roll 3 used in the method according to the invention in a perspective view and in a partial longitudinal cross-section. On the shaft 13 of the profiling guide roll 3, across the entire axial length of the shell of the roll, loading elements 14 are arranged next to each other, which loading elements can be controlled separately. The loading elements 14 are from their one end 14*a* connected to the shell of the roll 15, and from the other end 14*b* to the axis of the roll 13. The loading elements 14 support the shell 15 for example hydrostatically or hydraulically, thus affecting the shell within their own area of influence. In other words, the loading exerted by the loading elements 14 to the shell takes place in zones in the axial direction of the roll, wherein so-called profiling zones are formed in the shell. Each zone is supported by three loading elements 14 which have been installed at fixed intervals around the shaft 13. The loading exerted by the loading elements 14 to the shell 15 can be adjusted by controlling the pressure of the medium, for example oil, producing the load of the elements. The loading of the loading elements 14 can also be adjusted by means of the measurement result of a load measuring sensor positioned in the structure of the loading element 14. By loading the shell of the profiling guide roll 3 in its axial direction with different loads in different profiling zones, it is possible to change the tension profile of the supporting member 1 that is in contact with the guide roll in the lateral direction of the supporting member 1. The change in the tension profile also causes a corresponding change in the nip profile of the reeling nip. In the figure, letter P indicates one profiling zone, in which a change on the profile of the surface of the guide roll 3 has been produced by the influence of one loading element 14, said profile transferring to the tension profile of the supporting member. The shell 15 of the roll 3 may also be composed of a cylindrical elements that are in contact with each other, each of the elements being affected by a separate loading element 14. The profiling guide roll can also be replaced with several successively positioned, abutting rolls that are considerably shorter than the width of the supporting member, the axes of said rolls coinciding and said rolls forming a profiling guide roll 3 extending at least across the width of the supporting member 1. Each short roll element may thus comprise one or several loading elements 14. In both these alternatives the profiling guide roll is coated from outside with a continuous coating 16 that covers the entire shell 15.

When the profiling guide roll 3 is used in controlling the nip pressure of the reeling nip, the measurements necessary for determining the tension profile of the supporting member are conducted by means of measuring sensors attached either to the guide rolls 2 or 4 or to the supporting member 1, and the necessary changes in the tension profile can be attained by loading the guide roll 3 by means of the loading elements 14 so that the desired tension profile is attained in the supporting member 1, and thus the desired nip profile of the reeling nip is also attained. The measurements necessary for the adjustment and for determining the tension profile of the supporting member 1 can also be conducted directly on the basis of the measurements of the oil pressure of the loading elements 14 located in the guide roll 3 or the pressure of the hydraulic cylinder or the force of the cylinder piston of the cylinder. From the measurement results of the loading elements 14 it is also possible to determine the nip profile of the reeling nip N1 directly by using transfer functions.

Figure 6A:
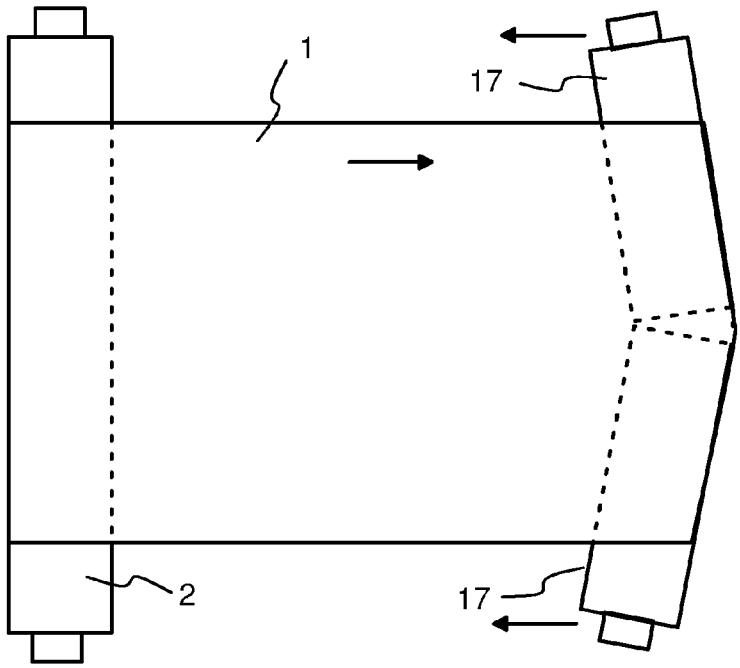
FIG. 6*a* shows schematically a supporting member used in the method according to the invention, as well as a guide roll guiding the same, in a top view.

Another embodiment for controlling the nip profile of the reeling nip according to the invention is to use the profiling guide roll 3 shown in FIG. 6*a* in the adjustment of the tension profile of the supporting member 1. The profiling guide roll 3 is in the embodiment of the figure composed of two roll components that are in contact with each other from their other end, the total length of the components extending across the width of the supporting member 1. When the nip profile of the reeling nip N1 is even and profiling is not necessary, the roll components 17 is arranged in such a manner that their longitudinal axes coincide and the guide roll 3 composed of the roll components 17 is substantially straight. When the tension profile of the supporting member 1 is changed, i.e. the nip profile of the reeling nip is adjusted, it takes place by moving the other end of the roll component/components in the machine direction as requested by said control command so that the desired change in the tension profile of the supporting member and thus in the nip profile of the reeling nip is attained. In FIG. 6*a* the ends of the roll components 17 on the side of the outer edge of the supporting member 1 have been moved against the machine direction in accordance with the arrows shown in the figure. FIG. 6*a* shows only two roll components 17, but there may, of course, be a larger number of them, and their axial length may vary. Similarly, the axial length between different components may vary. In this embodiment, the measurements necessary for determining the tension profile of the supporting element are conducted in the guide roll 2. It should be noted that the position of the turned roll components shown in FIG. 6*a* is shown in a highly exaggerated manner to facilitate the understanding of the situation. In the actual adjustment situation the turning movement is considerably smaller.

Figure 6B:
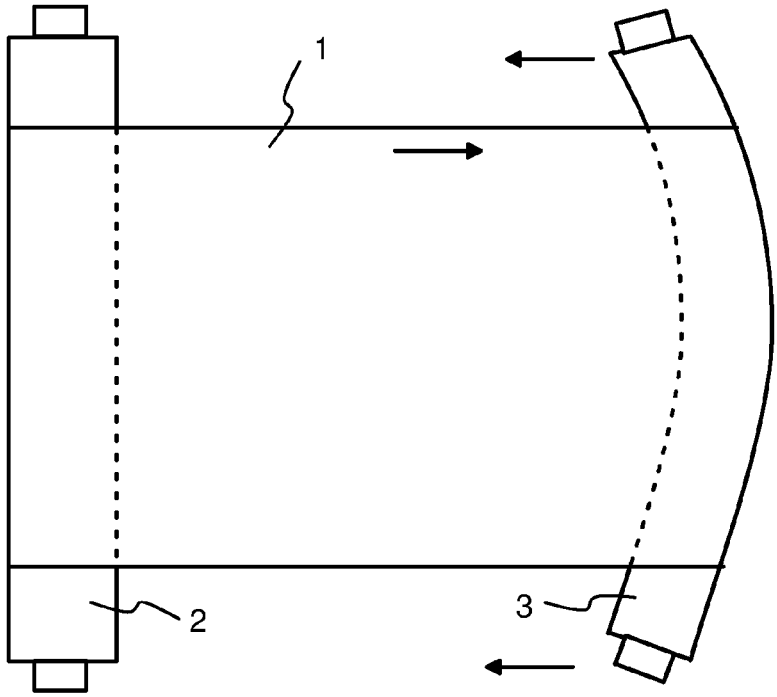
FIG. 6*b* shows schematically a second supporting member used in the method according to the invention, as well as a guide roll guiding the same, in a top view.

It is also possible to use a continuous, bending roll as a profiling guide roll 3, which alternative is shown in FIG. 6*b*. Thus, the profiling guide roll is made of such components that the bending of the same is possible. The act of changing the tension profile of the supporting member 1, i.e. controlling the nip profile of the reeling nip takes place in a similar manner as in FIG. 6*a*.

Figure 7:
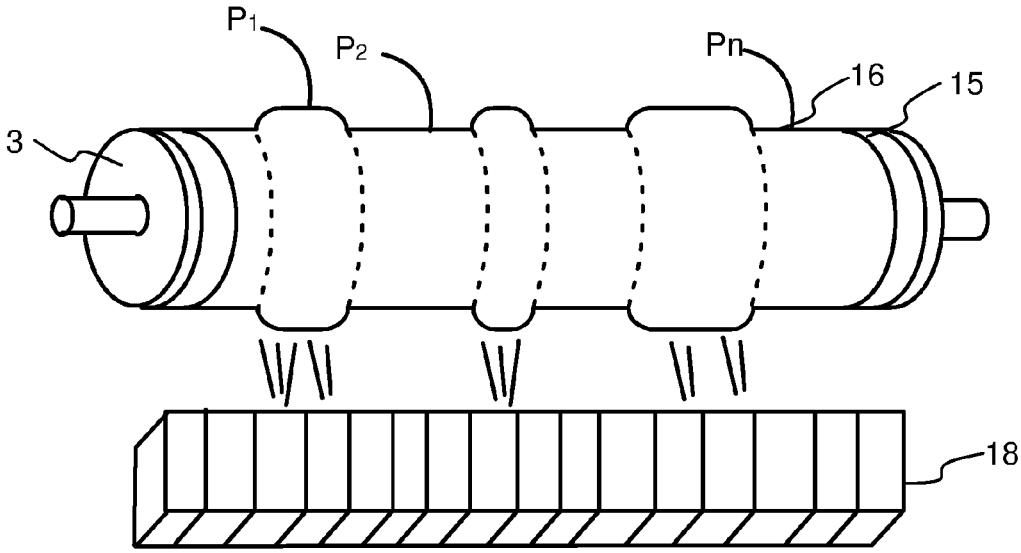
FIG. 7 shows schematically a guide roll used in the method according to the invention in a side view.

A third embodiment for adjusting the nip profile of the reeling nip N1 according to the invention is to adjust the tension profile of the supporting member by modifying the shape of the surface of the continuous profiling guide roll 3 in the axial direction. This can be conducted either by coating the shell of the profiling guide roll 3 with such a coating that when different kinds of stimuli are exerted on the coating, it is possible to change the profile of the surface of the roll, thus producing the desired tension profile in the supporting member 1, or by producing the shell of the profiling guide roll of a material which can be influenced by stimuli, thus also attaining the desired change in the surface of the profile of the roll, and the desired tension profile of the supporting member 1. FIG. 7 also shows in a schematical side view a profiling guide roll 3, which is provided with profiling zones $P_1, P_2 \ldots P_n$ and whose profile on the outer surface has been modified with different kinds of stimuli. The shell 15 of the guide roll, or the coating 16 of the shell in the axial direction of the roll is made in zones of material that reacts to stimuli, either in such a manner that a zone directed outward from the surface i.e. an elevation $P_1$, or a zone directed towards the shaft of the roll, i.e. a depression $P_2$ is formed on the surface of the roll. The profiling zones extend around the circumference of the roll in said axial point of the roll. The zones affect the tension profile of the supporting member in the following way: when there is an elevation at a certain point in the area of the shell of the guide roll 3, the tension of the supporting member that is in contact with the guide roll is stronger in said cross-direction zone of the supporting member, and thus a change is attained in the tension profile. Correspondingly, when there is a depression on the surface of the guide roll 3, the tension of the supporting member 1 in said cross-direction zone is smaller, which shows in the tension profile of the supporting member. The stimuli affecting the coating of the roll or the shell, may be external, i.e. stimuli exerted on the coating or on the shell from outside the roll, or internal stimuli exerted from inside the roll. The coating of the roll can be composed of several coating layers, of which one or several can be a coating layer reacting to stimuli, the location of which among the coating layers can vary.

The coating or shell material that reacts to stimuli may be for example a material reacting to variations in temperature, wherein changes in the material are attained by heating the roll by a heating method either inside or outside the roll. From outside the roll the shell or coating of the roll can be heated for example by means of blowing hot air, or IR radiation. The heating can be implemented either by means of point-like heaters affecting one axial zone of the roll at a time, or the heater can be continuous in the axial direction of the profiling guide roll, divided into zones in the longitudinal direction, said heater heating one or several coating zones in accordance with control commands. Such a heater is in FIG. 7 marked with the reference numeral 18. The heating efficiency can also be adjusted according to the requirements of the desired profiling effect. This embodiment of the invention sets strict demands for coating materials. The coating material must be selected carefully especially when the aim is to extend the heating effect on the shell underneath the coating. The coating must endure both the increase in temperature caused by heating and the change in the shape of the surface of the roll caused by heating without being damaged. From inside the roll the heating can be implemented for example by means of a heating medium. Thus, it is possible to bore channels in the shell of the roll in the axial direction of the roll, said channels circling the shell of the roll in zones, in which channels heating/cooling medium is conveyed to attain the desired profiling effect.

It is also possible to affect the metal shell of the guide roll by means of induction, wherein the shell of the roll is heated in the axial direction of the roll by means of electromagnetic coils, i.e. induction coils arranged next to each other outside the shell. Each coil can be controlled separately, wherein temperature profiling is attained, which through heat expansion of metal also affects the profile of the outer surface of the shell, and thus the tension profile of the supporting member. It is also possible to manufacture the shell of the guide roll 3 of magnetostrictive metal, or of so-called memory metal, whose properties, such as length and volume change under the effect of the magnetic field. In such a case, the beam 18 is replaced with means producing the magnetic field.

The profiling guide roll 3 can also be coated with an adaptive material such as magnetorheological rubber, whose thickness can be affected by means of a magnetic field. The components necessary for producing the magnetic field are installed for example in a beam parallel to the roll, said beam being installed in the vicinity of the roll so that the effect of the magnetic field extends to the roll. The force of the magnetic field is affected in zones in the axial direction of the guide roll, wherein the thickening of the rubber is attained in those zones which have a sufficiently strong magnetic field to produce the effect. It is also possible to coat the profiling guide roll with a material that reacts to the electric field and to electromagnetic radiation, such as UV light, IR light, laser light or to a microwave field.

Figure 8A:
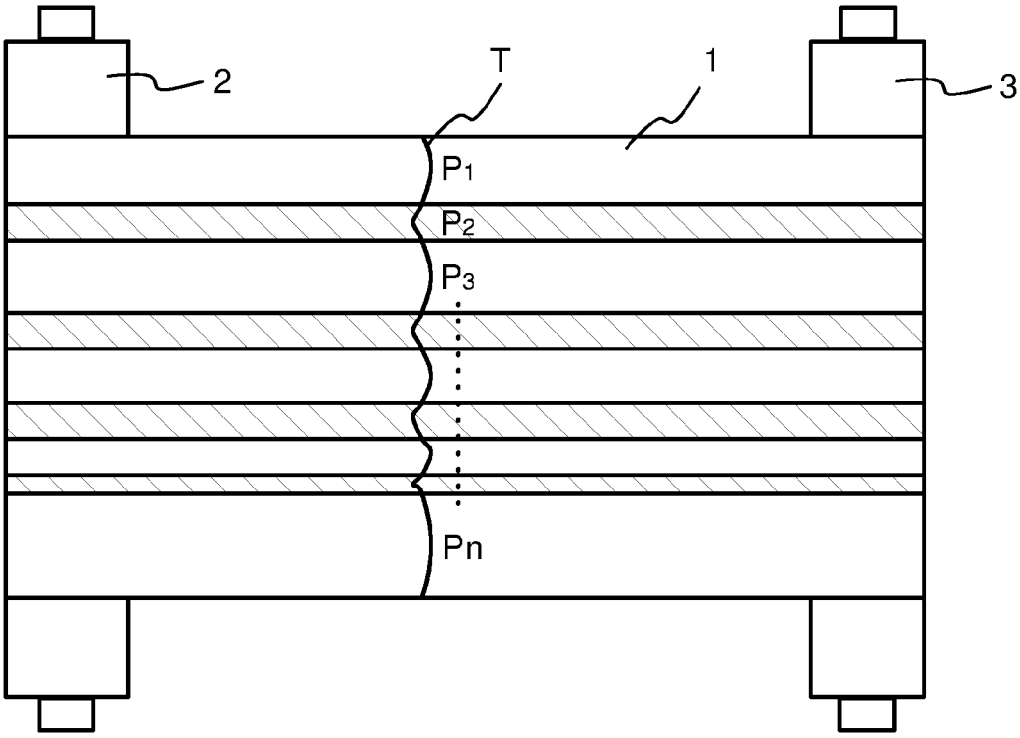
FIG. 8*a* shows schematically a supporting member used in the method according to the invention in a top view.
Figure 8B:
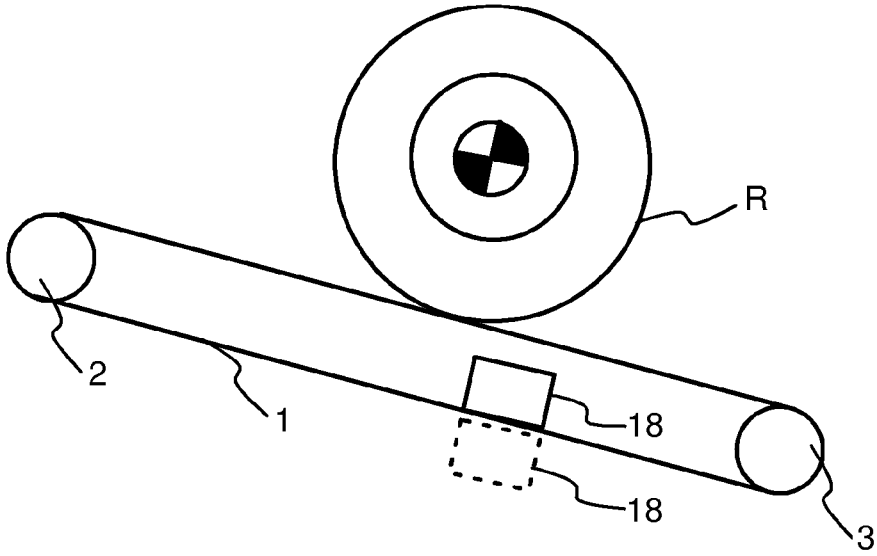
FIG. 8*b* shows schematically a part of the belt reeler in a side view, in which belt reeler profiling means used in the method according to the invention have been integrated.

One embodiment for controlling the nip profile of a reeling nip according to the invention is to directly affect the properties of the supporting member 1 in the cross-direction of the supporting member, thus producing a change in the tension profile of the supporting member. Thus, the supporting member is made of such a material which reacts to external stimuli so that the tension profile of the supporting member in its cross-direction changes under the effect of stimuli. The supporting member may be for example entirely made of a material that reacts for example to temperature, electric field, magnetic field or electromagnetic radiation that is exerted on the supporting member. FIG. 8*a* shows in a schematical top view the supporting member 1 and a change in the tension profile T produced therein by an external stimulus. Different profiling zones in the cross-direction of the supporting member are marked with letters $P_1, P_2 \ldots P_n$. External stimuli, such as heating or magnetic field can be exerted on the supporting member 1 for example by means of an arrangement shown in FIG. 8*b*, in which a beam-like member 18 is arranged perpendicularly across the width of the supporting member 1, to which member for example heating means or means producing the magnetic field are attached in such a manner that their effect extends to the supporting member 1. The beam 18 can be installed either inside or outside the loop of the supporting member, as shown by means of broken lines in FIG. 8*b*. The heating means or means producing the magnetic field are attached to the beam in zones in the longitudinal direction of the beam, wherein it is possible to affect the profiling guide roll 3 by means of them in zones, thus bringing about a profiling effect. The properties of the supporting member 1 its cross-direction can also be affected by manufacturing the supporting member to have only a part of the surface of the supporting member reacting to stimuli. Some of the wire threads forming the supporting member may, for example, be of a different material than the other wire threads.

The measurement signals necessary for the controlling of the above-mentioned profiling methods of the supporting member and thereby the nip profile of the reeling nip, in which methods the supporting member is affected directly, and profiling is not conducted by means of the guide roll, are obtained from a guide roll 2 or 3 that is in contact with the supporting member, in which guide roll measuring sensors 9 are arranged. Most advantageously, the guide roll 2 is used in the measurement. It is also possible to measure the measurement variables necessary for the control by means of sensors arranged in the supporting member and to use the supporting member for profiling. For example a piezoelectric actuator can function as a piezoelectric measuring sensor.

Figure 9:
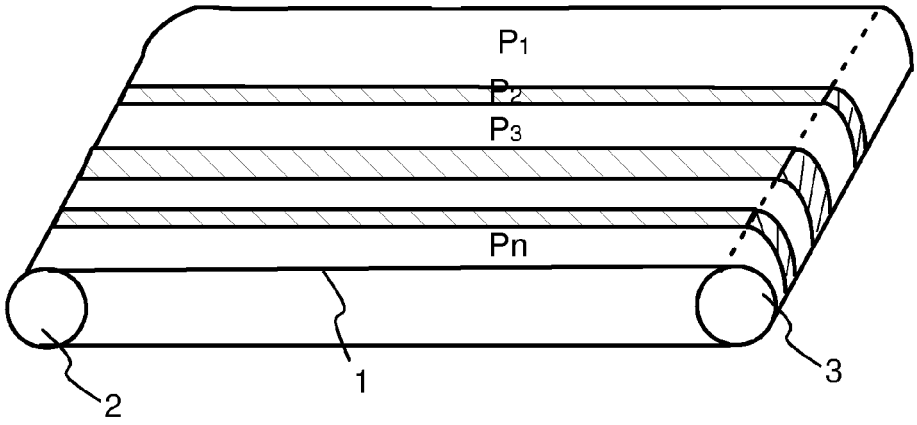
FIG. 9 shows schematically a supporting member used in the method according to the invention in a side view from the top.

It is possible to implement the controlling of the nip profile of the reeling nip, i.e. profiling without constant measurement of variables proportional to the tension of the supporting member and the tension profile determined therefrom by manufacturing the supporting member on the basis of a nip model formed beforehand, and by using it in the profiling. This alternative can be used for example in such a situation where there are no on-line measuring means needed for determining the tension profile of the supporting member or the nip profile of the reeling nip or control means reacting to stimuli available. Consequently, the supporting member is provided already at the manufacturing stage with different zones, profiling zones, in the cross-direction of the supporting member 1, said zones appearing in the tension profile of the supporting member. The zones can be formed either by manufacturing the different zones with wire threads of different materials, or by weaving the wire threads in different zones more tightly or loosely. This way, the properties of the supporting member, such as its elongation, modulus of elasticity, thickness, adhesion profile, friction profile or properties of the surface layers differ from each other in the cross-direction of the supporting member, which affects the tension profile of the supporting member. FIG. 9 shows a supporting member 1 that is manufactured so that it is different in different zones $P_1, P_2, P_3 \ldots P_n$ of the supporting member. In the cross-direction of the supporting member 1, it is also possible to form the supporting member 1 in such a manner that it varies in zones in the thickness direction (i.e. Z direction). The essential aspect is that the zones produce a desired change in the tension profile of the supporting member 1, and thus in the nip profile of the reeling nip.

Figure 10:
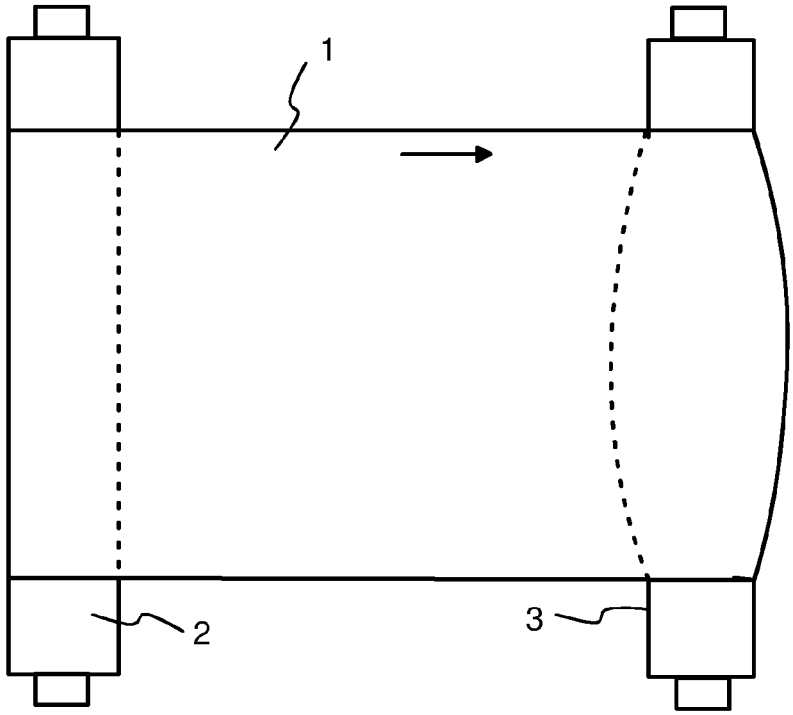
FIG. 10 shows schematically a supporting member used in the method according to the invention, as well as a guide roll guiding the same, in a top view.

Another embodiment of a control method of the nip profile of the reeling nip without a continuous measurement and active adjustment means is to use as a guide roll 3 a roll that has been manufactured so, that it is capable of functioning as a means profiling the supporting member. Such a roll is for example a crowned roll, which is shown in FIG. 10 as a roll profiling the supporting member.

Figure 11:
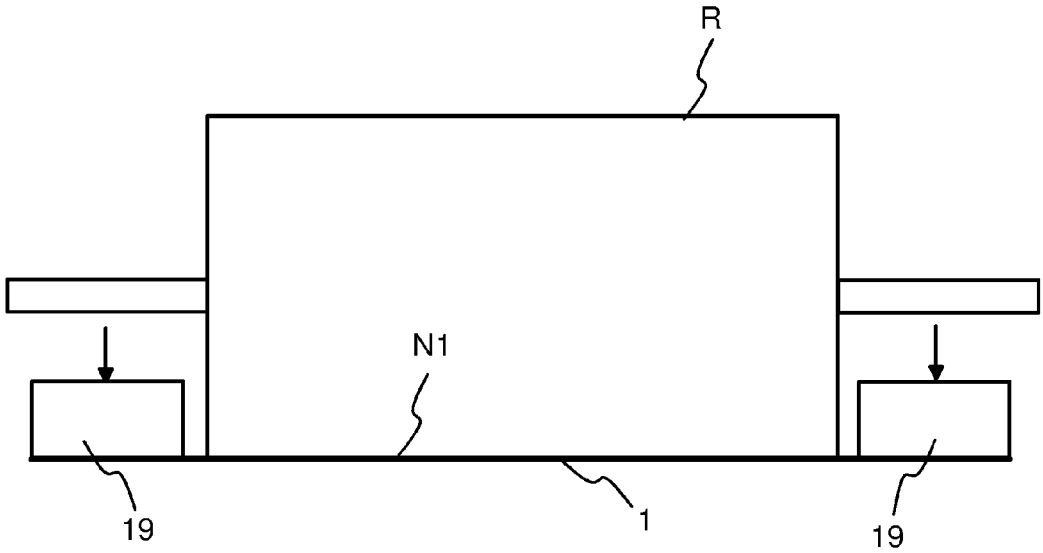
FIG. 11 shows schematically the profiling devices used in a method according to the invention, placed in a belt reeler and seen against the travel direction of the supporting member.

FIG. 11 shows an alternative for controlling the nip profile of a reeling nip, which can be utilized when the web to be reeled and the machine reel R thus formed is narrower than the supporting member 1. When reeling of a narrow web with a belt reeler, the problem is that the edge parts of the supporting member extending across the width of the web tend to bend upwards, which causes a linear load peak in the nip profile of the reeling nip in the edge parts of the web. This problem can be solved by arranging pressing devices 19 on both edges of the supporting member 1 that remain outside the width of the machine reel on both sides of the machine reel R. The pressing devices 19 press the edges of the supporting member downward so that the tension profile especially on the edge areas of the supporting member 1 is even. At the same time it is ensured that air exits the machine reel to be reeled. The pressing devices can be rolls rolling at the same speed with the supporting member, or "dragging" shaped profiles, wings or other devices that remain stationary. The surface of the pressing device that touches the supporting member 1 is in this case made of slippery wear-resistant material, such as metal, plastic, fiberglass, ceramics, teflon or glass. The pressing device may be shaped in such a manner that it imitates the nip of the machine reel, whose shape changes when the machine reel grows. The device may be for example profiled in such a manner that when it is turned in different positions, the nip produced by the pressing device becomes either shorter or longer/steeper or less steep. Between the pressing device 19 and the forming machine reel R there is a gap through which the air in the machine reel can escape. The escape of air can be intensified by means of suction. On the basis of the change in the nip profile produced as a result of measurements, the pressing devices 19 are activated, thus influencing the tension profile of the supporting member 1 and thereby the nip profile of the reeling nip N1.

The invention is not intended to be limited to the embodiments presented as examples above, but the invention is intended to be applied widely within the scope of the inventive idea as defined in the appended claims. Thus, it is obvious that the profiling roll can be any roll that is in contact with the supporting member, which can be located inside or outside the loop of the supporting member and it can be located before or after the reeling nip in the machine direction.

The invention claimed is:

1. A method for controlling a cross-direction nip profile of a reeling nip in a reeler in which the reeling nip is formed by a reeling core or a growing machine reel and at least one loop of an endless supporting member, which endless supporting member is continuous in a cross-direction which is the direction of an axis of the reeling core, the method comprising the steps of:

measuring variables proportional to tension of the endless supporting member in a cross-direction;

determining a cross-direction tension profile of the endless supporting member on the basis of the measured variables;

determining a cross-direction nip profile of the reeling nip based on the cross-direction tension profile of the endless supporting member;

controlling the cross-direction nip profile of the reeling nip by adjusting the cross-direction tension profile of the endless supporting member;

wherein the cross-direction tension profile of the endless supporting member is adjusted by a guide roll that is contained within the loop of the endless support member, and about which guide roll the endless support member wraps in contact with the said guide roll; and wherein the tension profile is adjusted by changing the shape of the guide roll.

2. The method according to claim 1, wherein the cross-direction tension profile of the endless supporting member is divided into profiling zones in the cross-direction which are adjusted.

3. The method according to claim 2, wherein the endless supporting member is divided into profiling zones in the cross-direction in accordance with a nip model.

4. The method according to claim 1, wherein a coating or shell of the guide roll that is in contact with the endless supporting member is divided into profiling zones in an axial direction of the guide roll.

5. The method according to claim 4, wherein the profiling zones of the shell of the guide roll are affected by loading elements supporting the shell of the guide roll, said loading elements being arranged across an axial length of the shell of the guide roll.

6. The method according to claim 4, wherein the cross-direction tension profile of the endless supporting member is adjusted by affecting the profiling zones of the coating or shell of the guide roll in accordance with a message based on the measured variables.

7. The method according to claim 4, wherein the coating or shell of the guide roll is divided into profiling zones in accordance with a nip model.

8. The method according to claim 1, wherein the guide roll is composed of at least two roll components each component having two ends and an axis, wherein the components are in contact with each other by adjoining roll ends so that the at least two roll components form the guide roll such that the guide roll extends across the width of the supporting member and can be bent where the ends contact each other, and wherein the cross-direction tension profile of the endless supporting member is adjusted by a turning movement wherein the guide roll is bent so that the at least two roll components rotate so the at least two roll components do not form a straight line and each roll component axis is rotated toward a machine direction.

9. The method according to claim 1, wherein the cross-direction tension profile of the endless supporting member is determined on the basis of variables proportional to the tension of the endless supporting member, said variables being measured by measuring sensors arranged in a guide roll that is in contact with the endless supporting member.

10. The method according to claim 9, wherein the guide roll in which the measuring sensors are arranged is located before the reeling nip in the machine direction.

11. The method according to claim 1, wherein the cross-direction tension profile of the endless supporting member is determined on the basis of variables proportional to the tension of the endless supporting member, said variables being measured by measuring sensors arranged in the endless supporting member.

12. The method according to claim 1 wherein the guide roll is a profiling guide roll which is located after the reeling nip in a machine direction.

13. The method according to claim 1, wherein the cross-direction tension profile of the endless supporting member is adjusted by pressing devices.

14. The method according to claim 1, wherein the endless supporting member has a width substantially the same as that of the growing machine reel.

15. A method for controlling a cross-direction nip profile of a reeling nip in a reeler in which the reeling nip is formed by a reeling core or a growing machine reel and at least one loop of an endless supporting member, which endless supporting member is substantially continuous in a cross-direction which is the direction of an axis of the reeling core, the method comprising the steps of:

measuring variables proportional to tension of the endless supporting member in a cross-direction;

determining a cross-direction tension profile of the endless supporting member on the basis of the measured variables;

determining a cross-direction nip profile of the reeling nip based on the cross-direction tension profile of the endless supporting member; and controlling the cross-direction nip profile of the reeling nip by adjusting the cross-direction tension profile of the endless supporting member;

wherein the cross-direction tension profile of the endless supporting member is adjusted by a guide roll that is in contact with the endless supporting member;

wherein a coating or shell of the guide roll that is in contact with the endless supporting member is divided into profiling zones in an axial direction of the guide roll;

wherein the profiling zones of the coating or shell of the guide roll are produced by forming the coating or shell of the guide roll of a material whose properties change when affected by a stimulus: and wherein the profiling zones of the coating or shell of the guide roll are affected by the stimulus and wherein the stimulus is temperature, an electric field, a magnetic field or electromagnetic radiation.

16. The method according to claim 15, wherein the profiling zones of the coating or shell of the guide roll are affected by a beam extending in parallel to the guide roll, said beam exerting the stimuli on the coating or shell of the guide roll.

17. An apparatus for controlling a cross-direction nip profile of a reeling nip in a reeler comprising:

a reeling core or a growing machine reel about the reeling core and at least one loop of an endless supporting member which is substantially continuous in a cross-direction, the cross-direction being the direction of an axis of the reeling core, and wherein the endless supporting member has a tension profile in the cross-direction;

wherein the reeling nip is formed by the reeling core or the growing machine reel and the endless supporting member;

measuring sensors positioned to measure variables proportional to the tension profile in the cross-direction of the endless supporting member;

a data processing unit connected in data receiving relation to the measuring sensors;

a means for adjusting the cross-direction tension profile of the endless supporting member, wherein the means for adjusting the cross-direction tension profile is in control message receiving relation to the data processing unit; and a guide roll contained within the loop of the endless support member, and about which the endless support member wraps in contact with the guide roll, wherein the means for adjusting the cross-direction tension profile of the endless supporting member is a means for changing the shape of the guide roll.

18. The apparatus of claim 17, wherein a coating or a shell of the guide roll is in contact with the endless supporting member and the coating or the shell of the guide roll is divided into profiling zones in an axial direction along an axial length of the guide roll.

19. The apparatus of claim 18, further comprising loading elements supporting the shell of the guide roll, said loading elements being arranged next to each other across the axial length of the shell of the guide roll, and said loading elements are arranged to affect the profiling zones of the coating or the shell of the guide roll.

20. The apparatus of claim 18, wherein the coating or shell of the guide roll is divided into profiling zones in accordance with a nip model.

21. The apparatus of claim 17, wherein the means for changing the shape of the guide roll is arranging the guide rolls of at least two roll components, each component having two ends and an axis, wherein the components are in contact with each other by adjoining roll ends so that the at least two roll components form the guide roll such that the guide roll extends across the width of the supporting member and can be bent where the ends contact each other by a turning movement of the roll components, such that each roll component's axis is rotatable toward a machine direction, wherein the cross-direction tension profile of the endless supporting member is arranged to be adjusted.

22. The apparatus of claim 17, wherein the guide roll is a bendable roll having ends such that the cross-direction tension profile of the endless supporting member is arranged to be adjusted by moving the ends of the roll in a machine direction.

23. The apparatus of claim 17, wherein the measuring sensors are arranged in a guide roll that is in contact with the endless supporting member.

24. The apparatus of claim 23, wherein the guide roll containing the measuring sensors is positioned before the reeling nip in a machine direction.

25. The apparatus of claim 17, wherein the measuring sensors are arranged in the endless supporting member.

26. The apparatus of claim 17, wherein the guide roll is located after the reeling nip in a machine direction.

27. The apparatus of claim 17, wherein the growing machine reel has a width, and wherein the endless supporting member has a width substantially the same as the width of the growing machine reel.

28. An apparatus for controlling a cross-direction nip profile of a reeling nip in a reeler comprising:

a reeling core or a growing machine reel about the reeling core and at least one loop of an endless supporting member which is substantially continuous in a cross-direction, the cross-direction being the direction of an axis of the reeling core, and wherein the endless supporting member has a tension profile in the cross-direction;

wherein the reeling nip is formed by the reeling core or the growing machine reel and the endless supporting member;

measuring sensors positioned to measure variables proportional to the tension profile in the cross-direction of the endless supporting member;

a data processing unit connected in data receiving relation to the measuring sensors; and a means for adjusting the cross-direction tension profile of the endless supporting member, wherein the means for adjusting the cross-direction tension profile is in control message receiving relation to the data processing unit;

wherein a coating or a shell of a guide roll is in contact with the endless supporting member and the coating or the shell of the guide roll is divided into profiling zones in an axial direction along an axial length of the guide roll;

wherein the coating or the shell of the guide roll is made of a material whose properties change in the profiling zones of the coating or the shell of the guide roll when affected by stimulus; and a source of stimulus directed at the profiling zones of the coating or the shell of the guide roll, and wherein the source of stimulus is a source of heat, a source of an electric field, a source of a magnetic field or a source of electromagnetic radiation.

29. The apparatus of claim 28, further comprising a beam extending parallel to the guide roll, said beam having sources of stimulus aimed at profiling zones of the coating or the shell of the guide roll.

* * * * *